United States Patent [19]

Pipalov

[11] Patent Number: 5,073,097

[45] Date of Patent: Dec. 17, 1991

[54] MULTI-CHAMBER ROTARY LOBE FLUID MACHINE WITH POSITIVE SLIDING SEATS

[76] Inventor: Aleksander G. Pipalov, 16282 Main St. #35G, Tustin, Calif. 92680

[21] Appl. No.: 264,448

[22] Filed: Oct. 28, 1988

Related U.S. Application Data

[63] Continuation-in-part of Ser. No. 36,712, Apr. 9, 1987, abandoned.

[51] Int. Cl.[5] ..... F01C 1/34; F01C 11/00; F01C 19/00

[52] U.S. Cl. ..... 418/175; 418/177; 418/258; 418/269

[58] Field of Search ..... 418/174, 175, 177, 184, 418/186, 260, 261, 6, 11, 13, 111, 173, 258, 269

[56] References Cited

U.S. PATENT DOCUMENTS

| | | | |
|---|---|---|---|
| 586,497 | 7/1897 | Isbell | 418/6 |
| 854,783 | 5/1907 | Voith | 418/177 |
| 1,872,361 | 8/1932 | Tackman | 418/6 |
| 1,999,187 | 4/1935 | Gerlat et al. | 418/177 |
| 2,099,193 | 11/1937 | Brightwell | 418/177 |
| 2,233,082 | 2/1941 | Kucher | 418/269 |
| 2,730,076 | 1/1956 | Hogue | 418/175 |
| 2,752,893 | 7/1956 | Oleskow | 418/186 |
| 2,990,109 | 6/1961 | Fraser | 418/6 |
| 3,078,671 | 2/1963 | Senser | 418/177 |
| 3,181,511 | 5/1965 | Johnson | 418/177 |
| 3,230,938 | 1/1966 | Hojnowski | 418/177 |
| 3,527,262 | 9/1970 | Fuchs | 418/174 |
| 3,544,245 | 12/1970 | Mowbray | 418/258 |
| 3,682,143 | 8/1972 | Leas | 418/177 X |
| 3,976,037 | 8/1976 | Hojnowski | 418/175 X |
| 4,477,231 | 10/1984 | Swift | 418/177 X |

FOREIGN PATENT DOCUMENTS

| | | | |
|---|---|---|---|
| 606568 | 6/1926 | France | 418/260 |
| 107449 | 12/1924 | Switzerland | 418/175 |
| 2183732 | 6/1987 | United Kingdom | 418/177 |

*Primary Examiner*—John J. Vrablik
*Attorney, Agent, or Firm*—Koda and Androlia

[57] ABSTRACT

A rotary fluid machine including a rotor provided with a plurality of lobes, a ring surrounding the rotor and with the lobes defining a plurality of chambers, a housing surrounding the ring and provided with a plurality of depressions which together with the ring define a plurality of chambers, a plurality of sealing vanes extending through the ring and engaging with the outer surface of the rotor and an inner surface of the housing, and fluid passages provided in the ring adjacent the sealing vanes with alternate fluid passages connected together.

9 Claims, 6 Drawing Sheets

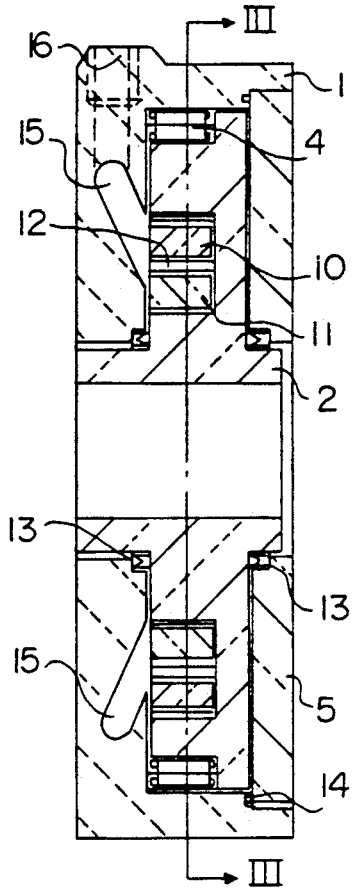
FIG. 2
FIG. 3
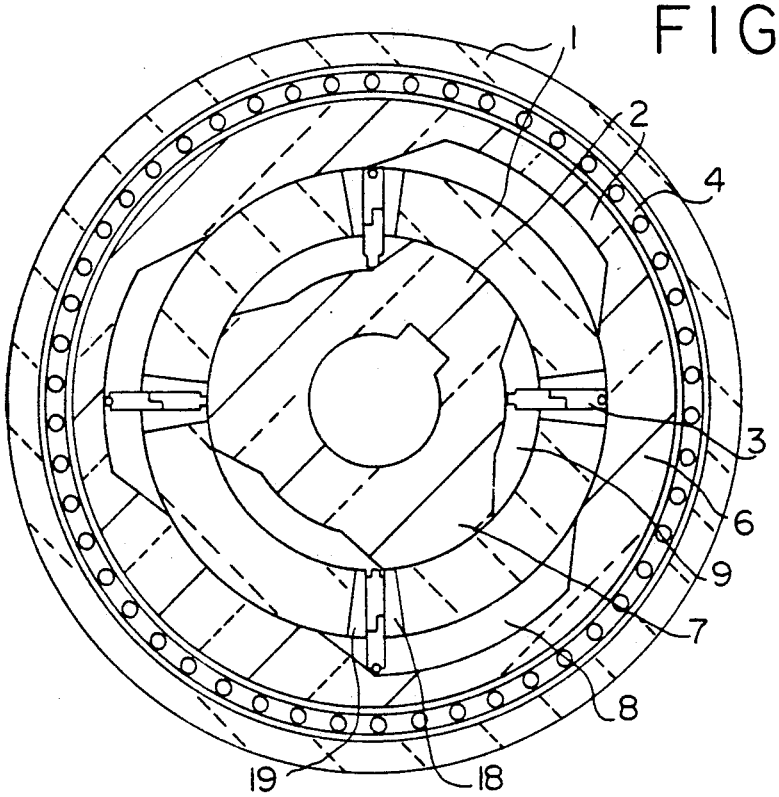

MULTI-CHAMBER ROTARY LOBE FLUID MACHINE WITH POSITIVE SLIDING SEATS

This is a continuation-in-part of application Ser. No. 036,712, filed Apr. 9, 1987, now abandoned.

BACKGROUND OF THE INVENTION

1. Field of the Invention

This device relates to rotary fluid machines and more particularly to rotary fluid pumps and rotary fluid motors.

2. Prior Art

In the prior art there exist rotary fluid pumps and rotary fluid motors. Such pumps and motors employ a rotor which revolves within a chamber provided in a stator, and the rotor is provided with radially guided vanes which revolve with the rotor and pass along a path between opposite curved faces of the stator, as the vanes are held in positive engagement with the profile of the stator. Each chamber of the stator is provided with inlet and outlet ports.

However, such fluid motors or pumps suffer from certain disadvantages. In particular, they are very inefficient in a wear aspect, and additionally they are speed and torque restricted. The primary reason for inefficiency is the fact that in such prior art rotary fluid pumps and motors, the vanes rotate with the rotor, and their rotating mass creates a centrifugal force and a hoop stress. As a result, vanes and stator curved faces wear unequally, as their outer sides wear more than their inner sides, i.e., they can not perform their primary function, to seal equally. Furthermore, considering that the centrifugal force and the hoop stress are proportional not only to the square of the rotating speed, but also to the centroidal radius; hence, it is clear that the prior art rotary machines are restricted in their diameter size, i.e. torque efficiency. In addition, by all of the prior art rotary machines, vanes are passing the ports and this could cause breakage or injury to the sealing surface of the vanes.

Another disadvantage of the prior art rotary machines is the fact that none of them is with wear compensated vanes proportionally to the applied pressure of the working fluid. As a result, any changes in the pressure of the fluid will affect the sealing effectiveness, i.e., the over-all efficiency of the rotary machine. In addition, the prior art rotary machines are very fluid contaminations sensitive, because of the sliding type seal between vanes and the stator surface.

Representative examples of such prior art rotary fluid machines are shown in the following United States patents: U.S. Pat. Nos. 315,318; 1,249,881; 2,099,193; 2,280,272; and 2,382,259.

SUMMARY OF THE INVENTION

Accordingly, it is a general object of the present invention to provide a rotary fluid machine which is more efficient than that provided by the prior art.

It is another object of the present invention to provide a rotary fluid machine which is not speed and torque restricted.

It still another object of the present invention to provide a rotary fluid machine wherein breakage or injury to the sealing vanes is prevented.

It is yet another object of the present invention to provide a rotary fluid machine wherein the sealing vanes are wear compensated.

It is an additional object of the present invention to provide a rotary fluid machine which is simple to manufacture and assemble.

In keeping with the principles of the present invention, the objects are accomplished by a unique rotary fluid machine which includes a rotor provided with a plurality of lobes, a ring surrounding the rotor with the lobes defining a plurality of first fluid chambers. In addition, a housing surrounds the ring and is provided with a plurality of depressions which together with the ring define a plurality of second fluid chambers. A plurality of sealing vanes extend through the ring and engage with the outer surface of the rotor and the inner surface of the housing and fluid passages are provided in the ring adjacent the sealing vanes with alternate fluid passages coupled together and the fluid passages communicate with the first and second fluid chambers.

BRIEF DESCRIPTION OF THE DRAWINGS

The above described features and objects of the present invention will become more apparent with reference to the following description taken in conjunction with the accompanying drawings wherein like reference numerals denote like elements and in which:

FIG. 2 is a cross-sectional view through plane II—II FIG. 1 in accordance with the present invention;

FIG. 3 is a cross-sectional view through plane III—III in FIG. 2 in accordance with the present invention;

DETAILED DESCRIPTION OF THE INVENTION

Figure 1:
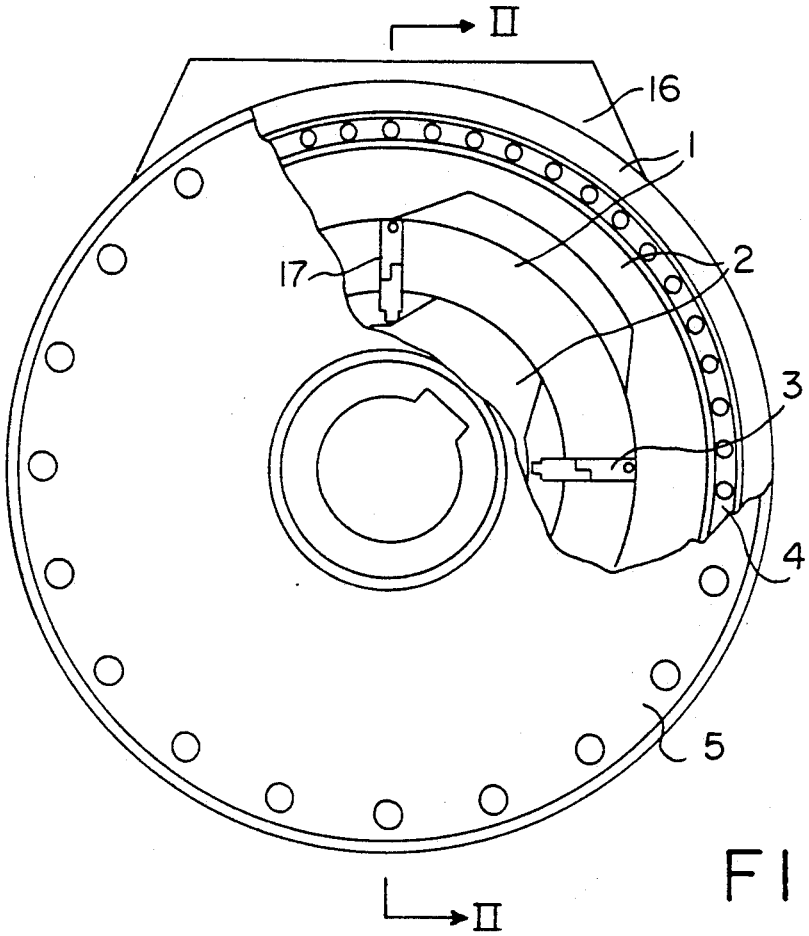
FIG. 1 is a top assembly with a broken-out section of a rotary fluid machine in accordance with the present invention.

Referring particularly to the Figures, shown in FIGS. 1–6 and 11 is a rotary fluid machine in accordance with the present invention. The rotary fluid machine generally comprises a stator 1 which preferably has an annular or ring shaped body, which is provided with radial guide slots 17 for guiding wear compensated vanes 3, which being held in positive engagement with the profile of the rotor 2, which comprises an inner and an outer rotor, shift radially in and out as the rotor 2 rotates. The stator 1 is enveloping the rotor 2 and bearing 4. The vanes 3 further are designed in such a way that the length of the lines defined by any two opposite sealing points of one and the same vane are equal to the radial distance between the outer surface of the inner rotor and the inner surface of the outer rotor. An opposite curved face of the rotor 2 is forming outer lobes 6 with corresponding outer chambers 8. Outer lobes 6 and inner lobes 7 are held in sealing engagement with stator 1. Inlet ports 18 and outlet ports 19 (or reverse) are provided on the stator 1 and communicate either alternately or simultaneously with outer rotor chambers 8 and with inner rotor chambers 9. Ports 18 and 19 are connected to the ports 16 through internal passages 15 in any manner well known in the art and are provided on opposite sides of and very close to each vane 3. Rotor 2, vanes 3 and bearing 4 are covered in the stator 1 by side plate 5 bolted to the stator 1. Plate 5 and rotor 2 are sealed by O-ring 14 and rotary seal 13 in any manner well known in the art.

Figure 8:
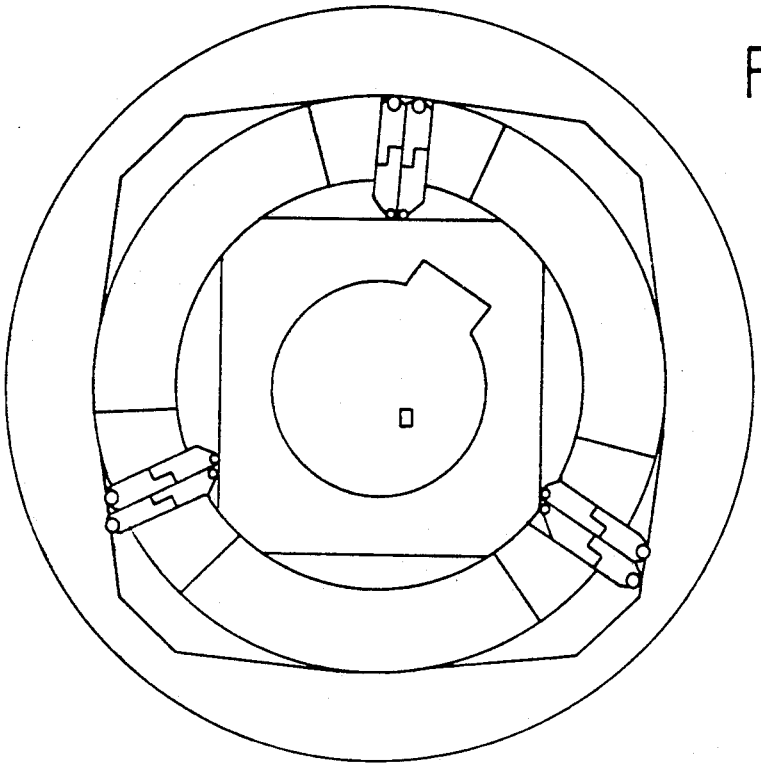
FIG. 8 is a cross-sectional view of a mesh of a four-lobe rotor and a three-vane stator in accordance with the present invention.
Figure 9:
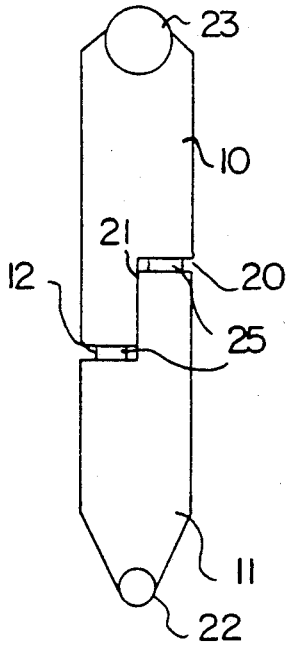
FIG. 9 is a front view of a single wear compensated sealing vane in accordance with the present invention.
Figure 10:
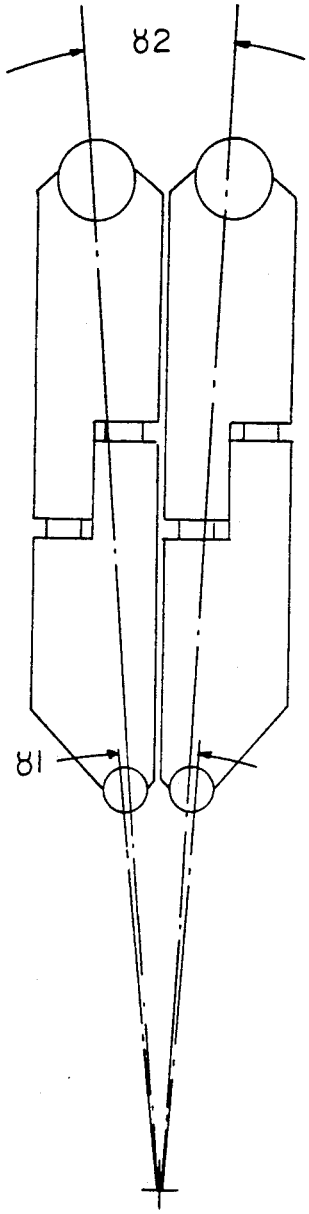
FIG. 10 is a front view of a double wear compensated sealing vane in accordance with the present invention.
Figure 11:
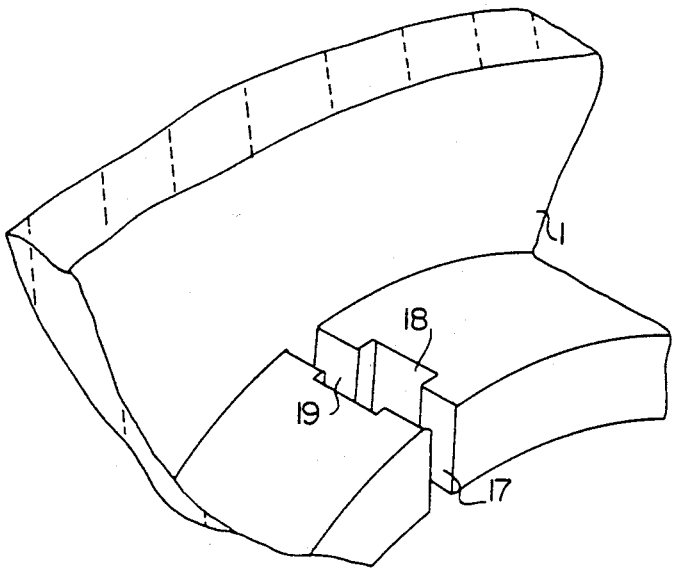
FIG. 11 is an isometric broken-out section of the stator showing a vane slot and the corresponding inlet and outlet ports in accordance with the present invention.

Referring to the FIG. 9 and FIG. 10, the wear compensating vane 3 employs an outer sliding vane 10 and inner sliding vane 11, which are provided with positive rolling contact seals 22 and 23. Sliding vanes 10 and 11 are held in positive engagement with the profile of rotor 2 through a means of spring force 25 provided in the small pressure chambers 12 and 20 formed between sliding vanes 10 and 11. Small pressure chambers 12 and 20 are separated through sliding surfaces 21. When wear compensating vanes 3 are mounted in the radial guide slots 17 of the stator 1, small pressure chambers 12 and 20 are held in connection with supply ports 18 and 19. In this manner, any change of the fluid pressure will affect proportionally the radial sealing force. Vane 3 will also compensate any variations of radial distances of rotor 2 due to irregularities of workmanship or thermal expansions. Sealing vane 3 may be just a single unit as shown in FIG. 9 or a set of two or more units as shown in FIG. 8. However, it is preferably the inner rollers envelope angle $\sphericalangle\gamma 1$, to be equal to the outer rollers envelope angle $\sphericalangle\gamma 2$, as seen in FIG. 10 the roller's envelope angle is the angle between two sealing points on the most apart rollers of any particular seal. Also typical small pressure chambers 12 and 20 formed between the sliding vanes shall be connected to each other through internal passages.

Figure 4:
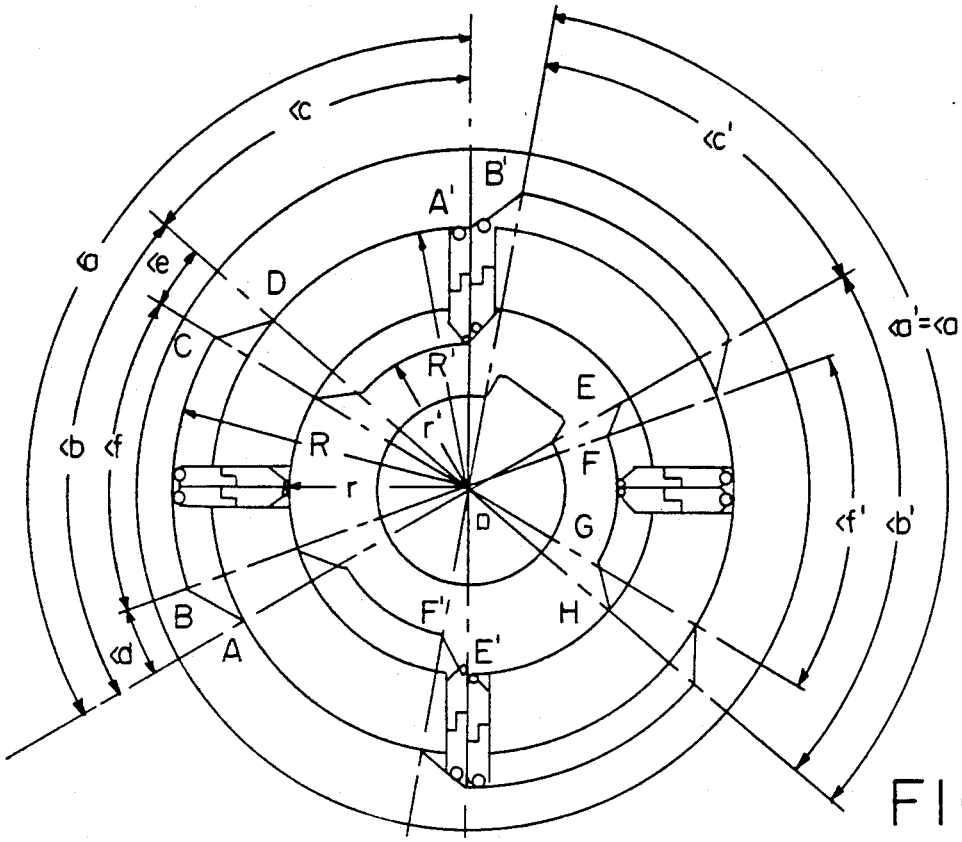
FIG. 4 is a cross-sectional view of a mesh of a three-lobe rotor and a four-vane stator in accordance with the present invention.
Figure 5:
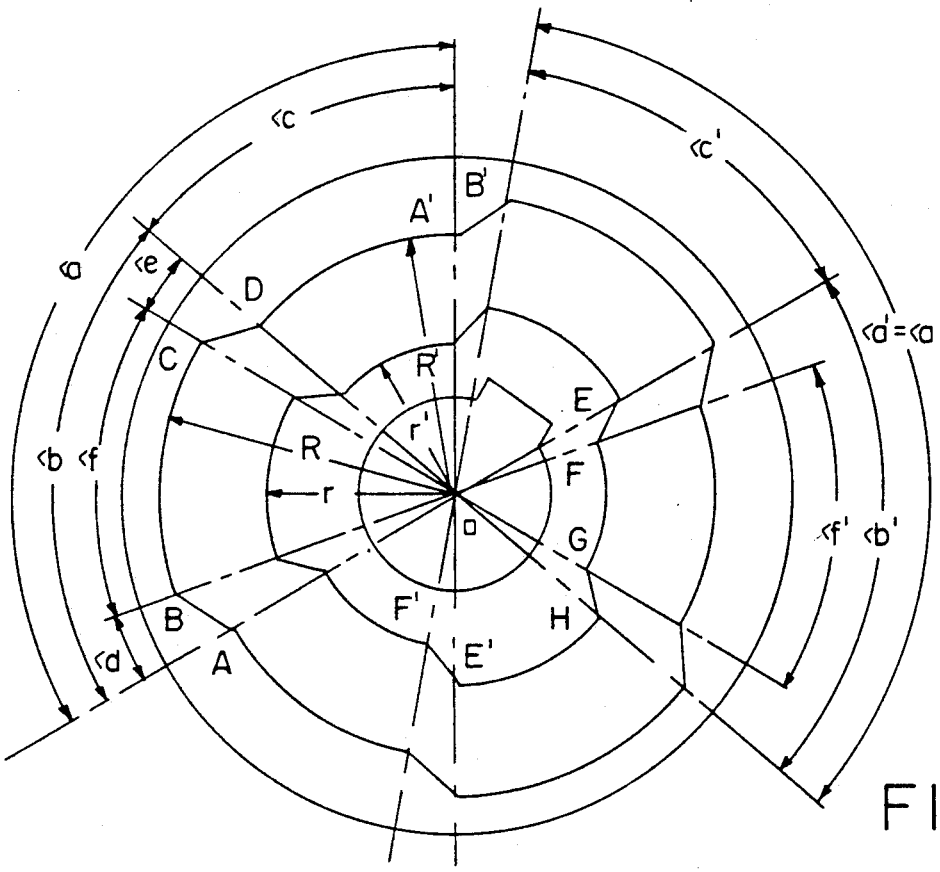
FIG. 5 is a view of a three-lobe rotor in accordance with the present invention.
Figure 6:
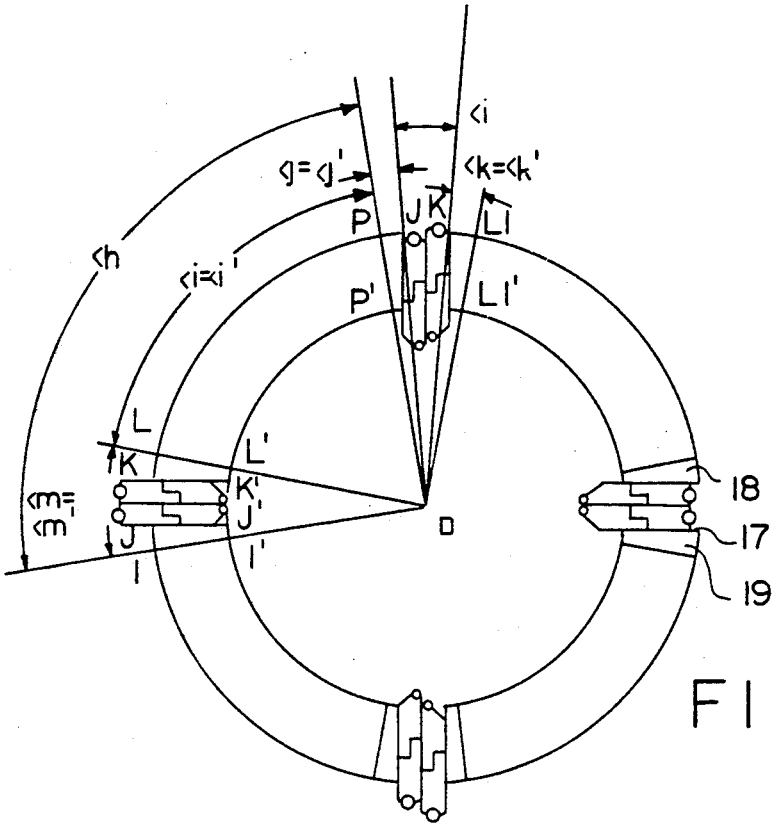
FIG. 6 is a cross-sectional view of a four vane stator in accordance with the teaching of the present invention.

For better understanding of the present invention certain terms will be introduced. Referring to FIGS. 4, 5, 6, points A, B, C, D define an outer rotor chamber 8; points E, F, G, H define an inner rotor chamber 9; points C, D, A', B' define an outer rotor lobe 6; points G, H, E', F' define an inner rotor lobe 7; points A, O, B define a left slope angle of outer chamber 8 . . . $\sphericalangle d$; points B, O, C outer chamber 8 profile angle . . . $\sphericalangle f$; points C, O, D define a right slope angle of outer chamber 8 . . . $\sphericalangle e$; points D, O, A' define outer lobe 6 sealing zone angle . . . $\sphericalangle c$; points A, O, A' define the rotor pitch angle . . . $\sphericalangle a$; points E, O, F define left slope angle of inner chamber 9 angle . . . $\sphericalangle d'$; points F, O, G define inner chamber 9 profile angle . . . $\sphericalangle f'$; points G, O, H define right slope angle of inner chamber 9 . . . $\sphericalangle e'$; points H, O, E' define inner lobe 7 sealing zone angle . . . $\sphericalangle c'$; points E, O, E' define the rotor pitch angle , , , $\sphericalangle a' = \sphericalangle a$; points I, O, J define an angle of an outer opening of port 18 . . . $\sphericalangle j$; points I', O, J' define an angle of an inner opening of port 18 . . . $\sphericalangle j'$; points J, O, K define an angle of an outer opening of guide slot 17 . . . $\sphericalangle 1$; points J', O, K' define an angle of an inner opening of guide slot 17 . . . $\sphericalangle 1'$; points K, O, L define an angle of an outer opening of port 19 . . . $\sphericalangle k$; points K', O, L' define an angle of an inner opening of port 19 . . . $\sphericalangle k'$; points L', O, P' define an angle of an inner sealing zone of stator 1; points D, O, A define the angular width, o' of outer rotor chamber 8 . . . i'; points I, O, P define the stator 1 pitch angle . . . h; points I', O, P' define the stator 1 pitch angle . . . h'—h.

It is not subject of this application to explain all equations describing the present invention. However, the following equations must be recognized for constructing a rotary fluid machine in accordance with the present invention.

In particular, the outer sealing zone angle of stator i must be always equal or greater than the sum of the left slope angle d, the outer chamber profile f and the right slope angle e of the outer rotor chamber 9, i.e.;

$$i > d + f + e$$

$$i > b \qquad (1)$$

The same rule applies also to the inner rotor chamber 8, i.e.;

$$i' > d' + f' + e'$$

$$i' > b' \qquad (2)$$

The number of the outer rotor lobes 9 must be always equal to the number of the inner rotor lobes 7; the rotor lobes number Z lob is defined by the following equation:

$$Z\ lob = 360/\ a \qquad (3)$$

The number of sealing vanes Z van is defined as follows:

$$Z\ van = 360/\ h \qquad (4)$$

The number of lobes could be greater, equal to or less than the number of sealing vanes Z van.

$$Z\ lob >= < Z\ van \qquad (5)$$

In operation, stator 1 is held stationary and pressurized fluid is injected into inlet ports 18, the rotor 2 would start to rotate. Furthermore, the rotary fluid motor could be reversed in direction or braked by reversing the inlet and outlet ports 18 and 19 to which the pressurized fluid is applied. In addition, the fluid is injected into all chambers at the same time and then taken out of all of the chambers at the same time to provide simultaneous multistage operation.

Figure 7:
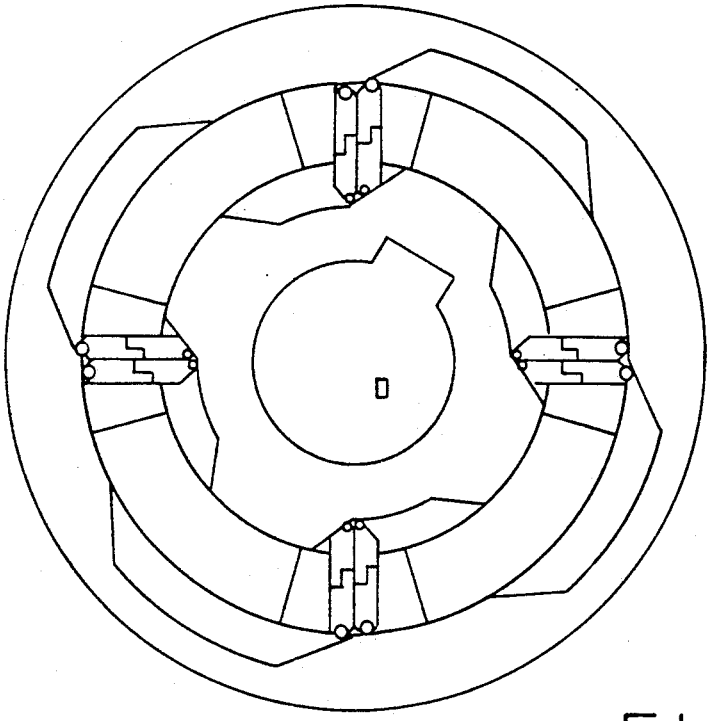
FIG. 7 is a cross-sectional view of a mesh of a four-lobe rotor and a four-vane stator in accordance with the present invention.

Referring to FIG. 7 shown therein is another embodiment of the present invention, where the number of lobes is equal to the number of vane seals.

Referring to FIG. 8 shown therein is still another embodiment of the present invention, where the number of lobes is greater than the number of vane seals.

It should be apparent to one skilled in the art that all embodiments operate in substantially the same manner as discussed with reference to the first embodiment.

It should further be apparent to those skilled in the art that the above described embodiments are merely illustrative of but a few of the many possible specific embodiments which represent the applications and principles of the present invention. Numerous and varied other arrangements can be readily devised by those skilled in the art without departing from the spirit and scope of the present invention. In particular, it should be apparent that in FIG. 1 the rotor 2 could be stationary and the stator 1 could rotate.

I claim:

1. A multi-chamber rotary fluid machine comprising:

an inner member provided with a plurality of lobes;

a ring surrounding said inner member and with said lobes defining a plurality of first fluid chambers;

a housing surrounding said ring, said housing being provided with a plurality of depressions which together with said ring define a plurality of second fluid chambers;

a plurality of sealing vanes extending through said ring and engaging with an outer surface of said inner member and an inner surface of said housing, said sealing vanes being provided in any number relative to the number of lobes of said rotor; and a plurality of fluid communicating means provided in said ring adjacent said sealing vanes with every other of said plurality of fluid communicating means being coupled together and with each of said plurality of said fluid communicating means in communication with said first and second fluid chambers.

2. A rotary fluid machine according to claim 1, wherein vanes are designed such that the length of the lines defined by any two opposite sealing points on one and the same vane is equal to a radial distance between an outer surface of the inner member and an inner surface of the housing.

3. A rotary fluid machine according to claim 2, wherein said ring is fixed and said inner member and housing rotate.

4. A rotary fluid machine according to claim 1, wherein means is provided for applying fluid to all of said first and second chambers at the same time and for taking fluid out of all of said first and second chambers at the same time.

5. A rotary fluid machine according to claim 2, wherein the number of sealing vanes is less than the number of lobes of said inner member.

6. A rotary fluid machine according to claim 2, wherein said sealing vanes comprises wear compensating vanes.

7. A rotary fluid machine according to claim 1, wherein each of said plurality of sealing vanes comprises two wear compensating vanes.

8. A rotary fluid machine according to claim 7, further comprising small pressure chambers formed between said two wear compensating vanes.

9. A rotary fluid machine according to claim 8, wherein the length of a line extending between opposite sealing points on one and the same vane of said plurality of sealing vanes is equal to a radial distance between the outer surface of the inner member and the inner surface of the housing.

* * * * *